US007342550B2

(12) United States Patent
Sanford et al.

(10) Patent No.: US 7,342,550 B2
(45) Date of Patent: Mar. 11, 2008

(54) RUGGED, METAL-ENCLOSED ANTENNA

(75) Inventors: John Sanford, Encinitas, CA (US); Athanasios Petropoulos, Lowell, MA (US)

(73) Assignee: Cushcraft Corporation, Manchester, NH (US)

( * ) Notice: Subject to any disclaimer, the term of this patent is extended or adjusted under 35 U.S.C. 154(b) by 0 days.

(21) Appl. No.: 11/155,082

(22) Filed: Jun. 17, 2005

(65) Prior Publication Data

US 2006/0284778 A1 Dec. 21, 2006

(51) Int. Cl.
*H01Q 13/10* (2006.01)

(52) U.S. Cl. ..... 343/771

(58) Field of Classification Search ..... 343/767, 343/770, 771, 789

See application file for complete search history.

(56) References Cited

U.S. PATENT DOCUMENTS 4,443,802 A * 4/1984 Mayes ..... 343/729
4,710,775 A * 12/1987 Coe ..... 343/727
5,406,292 A * 4/1995 Schnetzer et al. ... 343/700 MS
6,538,618 B2 * 3/2003 Yamamoto et al. ..... 343/789
7,136,024 B2 * 11/2006 Yuanzhu et al. ..... 343/767

OTHER PUBLICATIONS

Hall, et al., "Performance Enhancements for Aperature Coupled Microstrip Antennas", IEEE Antennas and Propagation Society International Symposium, IEEE 1992. pp. 1040-1043.
Sullivan, P.L. et al., "Analysis of Aperature Coupled Patch Antenna", 1985 IEEE/AP-S/URSI International Symposium, Vancouver, Canada, Elliott, Antenna Theory and Design, Chapter 3.5, Waveguide-Fed Slots, Prentice-Hall, Inc. 1981, pp. 88-99.
Lindberg, C.A., "A Shallow-Cavity UHF Crossed-Slot Antenna", IEEE Transactions on Antennas and Propagation, vol. AP-17, No. 5, Sep. 1969, pp. 558-563.
King, H.E., et al., "A Shallow Ridged-Cavity Crossed-Slot Antenna for the 240- to 400-MHz Frequency Range", IEEE Transactions on Antennas and Propagation, Sep. 1975, pp. 687-689.

* cited by examiner

*Primary Examiner*—Michael C. Wimer
(74) *Attorney, Agent, or Firm*—Harness, Dickey & Pierce, P.L.C.

(57) ABSTRACT

The antenna includes a metallic enclosure having a height dimension. At least one slotted opening is formed along the metallic enclosure. Each slotted opening has a slotted opening length and a slotted opening width. The slotted opening length is at least twice as long as the slotted opening width is wide. The slotted opening width is less than one wavelength wide and the slotted opening width is within a half wavelength of the height dimension. At least one feed is provided at least partially within the enclosure.

13 Claims, 6 Drawing Sheets

RUGGED, METAL-ENCLOSED ANTENNA

FIELD OF THE INVENTION

The present invention generally relates to antennas and, more specifically, to antennas within protective metallic enclosures.

BACKGROUND OF THE INVENTION

In many wireless applications it is desirable to deploy an antenna that is extremely durable. One such example is Radio Frequency Identification ("RFID"). Antennas are deployed on structures such as dock doors and forklifts where they can be bumped by crates and moving equipment. Antennas required for RFID applications are generally easily damaged and, as a result, are regularly mounted in locations that are diminish their performance to keep them out of harm.

Other antennas, which are more durable, lack the signal characteristics to be used in many types of RFID applications. Waveguide slot antennas, for instance, are well known in the industry. Waveguide slot antennas may be constructed normally from durable materials. However, waveguide slot antennas generally have relatively small frequency bandwidths. Preferably, an antenna for use in RFID applications would have a greater frequency bandwidth than a waveguide slot antenna, to at least cover a greater portion of the RFID standard 850-960 MHz frequency band. Also, the exterior of the waveguide slot antenna is the antenna element and damage to that exterior will damage the antenna.

Another antenna known in the art is an aperture coupled patch antenna. The aperture coupled patch antenna includes, in some designs, a radiating patch element etched on the top of the antenna substrate, a feed line formed on the feed substrate, and an aperture therebetween, at least partially exposing the patch element to the feed line. The thickness and dielectric constants of these two substrates may vary, depending upon the desired electrical functions of radiation and circuitry. Most aperture coupled patch antennas use rectangular slots, or variations thereof. The aperture coupled patch antenna involves over a dozen material and dimensional parameters, making construction difficult and leaving the antenna sensitive to imperfections. The aperture coupled patch antenna is yet another antenna insufficiently durable to withstand warehouse applications and other similar environments.

Thus, a heretofore unaddressed need exists in the industry to consider and address the aforementioned deficiencies and inadequacies.

SUMMARY OF THE INVENTION

Embodiments of the present invention provide a system and method for providing a rugged, metal-enclosed antenna.

Briefly described, in architecture, one embodiment of the system, among others, can be implemented as follows. The antenna includes a metallic enclosure having a height dimension. At least one slotted opening is formed along the metallic enclosure. Each slotted opening has a slotted opening length and a slotted opening width. The slotted opening length is at least twice as long as the slotted opening width is wide. The slotted opening width is less than one wavelength wide and the slotted opening width is within a half wavelength of the height dimension. At least one feed is provided at least partially within the metallic enclosure.

The present invention can also be viewed as providing a method of assembling an antenna, the method comprising the steps of: creating a metallic enclosure having a height dimension; forming at least one slotted opening along the metallic enclosure, wherein each slotted opening has a slotted opening length and a slotted opening width and the slotted opening length is at least twice as long as the slotted opening width is wide, and wherein the slotted opening width is less than one wavelength wide and the slotted opening width is within a half wavelength of the height dimension; and attaching at least one feed at least partially within the metallic enclosure.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
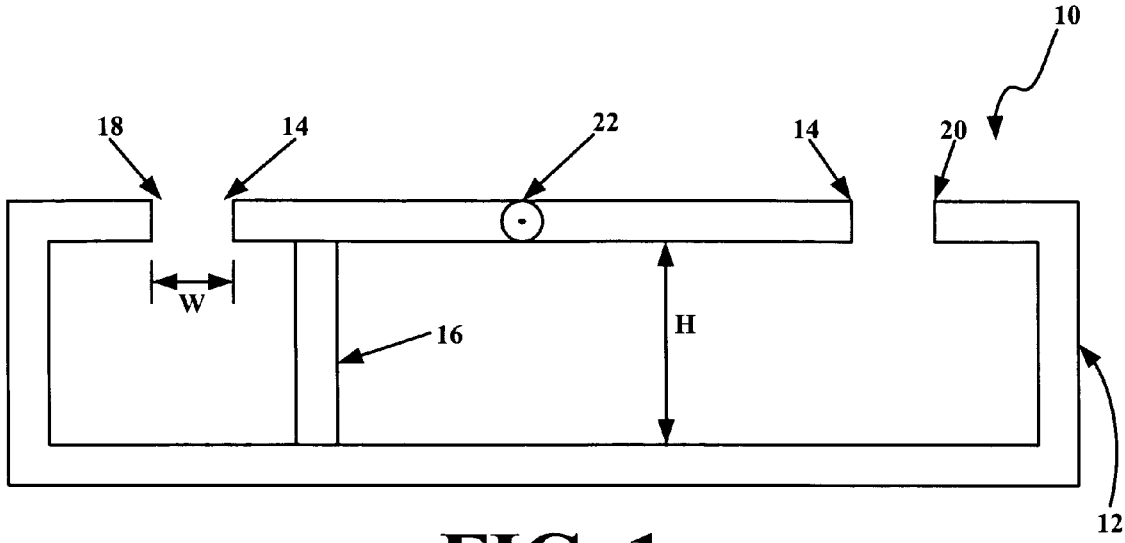
FIG. 1 is a cross-sectional side view of an antenna, in accordance with a first exemplary embodiment of the invention.
Figure 2:
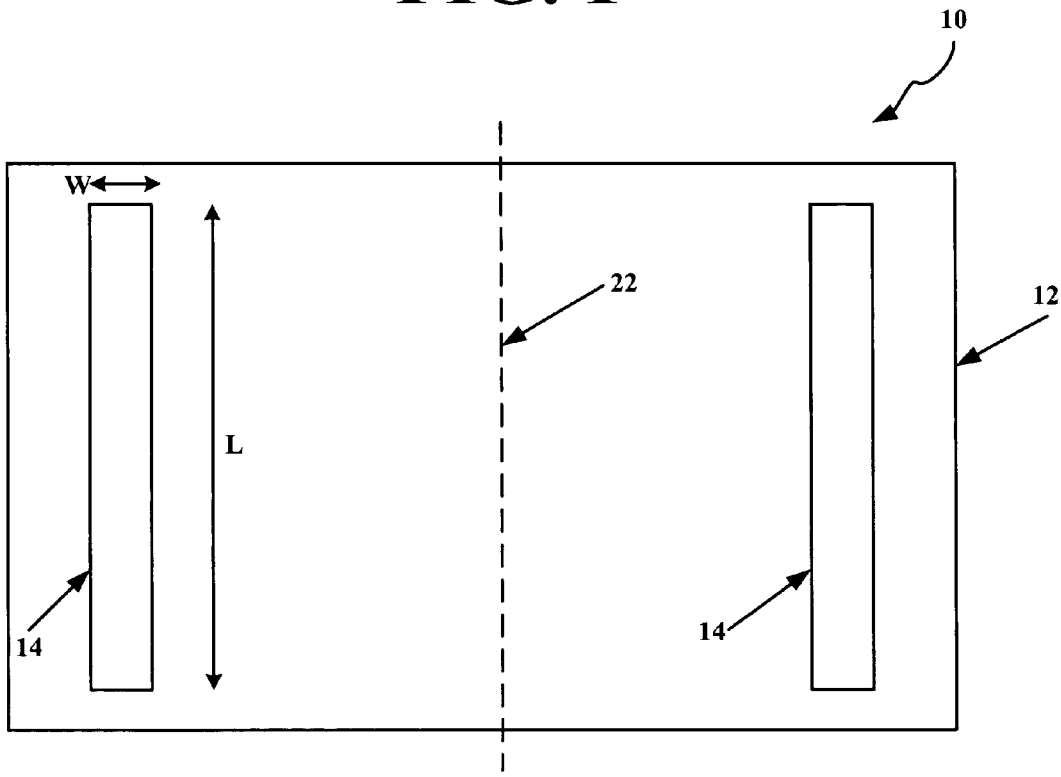
FIG. 2 is a top view of the antenna of FIG. 1, in accordance with the first exemplary embodiment of the invention.

FIG. 1 is a cross-sectional side view of an antenna 10, in accordance with a first exemplary embodiment of the invention. FIG. 2 is a top view of the antenna 10, in accordance with the first exemplary embodiment of the invention. The antenna 10 includes a metallic enclosure 12 having a height dimension H. At least one slotted opening 14 is formed along the metallic enclosure 12. Each slotted opening 14 has a slotted opening length L and a slotted opening width W. The slotted opening length L is at least twice as long as the slotted opening width W is wide. The slotted opening width W is less than one wavelength wide and the slotted opening width W is within a half wavelength of the height dimension H of the metallic enclosure 12. At least one feed 16 is provided at least partially within the metallic enclosure 12.

As shown in FIG. 1 and FIG. 2, the at least one slotted opening 14 in the first exemplary embodiment includes two slotted openings 14 along the metal enclosure. The slotted openings 14, include a proximate slotted opening 18 and a distal slotted opening 20 in parallel along a single side of the metallic enclosure 12. Other configurations of the slotted openings 14 are within the scope of the invention, including nonlinear slotted openings, intersecting slotted openings, and configurations having more or less than two slotted openings. Those having ordinary skill in the art will recognize the many possible configurations that exist.

The at least one feed 16 may be a probe feed located at least partially within the metallic enclosure 12. The feed 16 may be positioned closer to the proximate slotted opening 18 than to the distal slotted opening 20. Shown in FIG. 2 is a slotted opening axis 22 located midway between the distal slotted opening 20 and the proximate slotted opening 18. The feed 16 may be located approximately 0.25 wavelengths from the slotted opening axis 22. The feed 16 is protected from physical abuse by the metallic enclosure 12, which substantially encompasses the feed 16.

Figure 3:
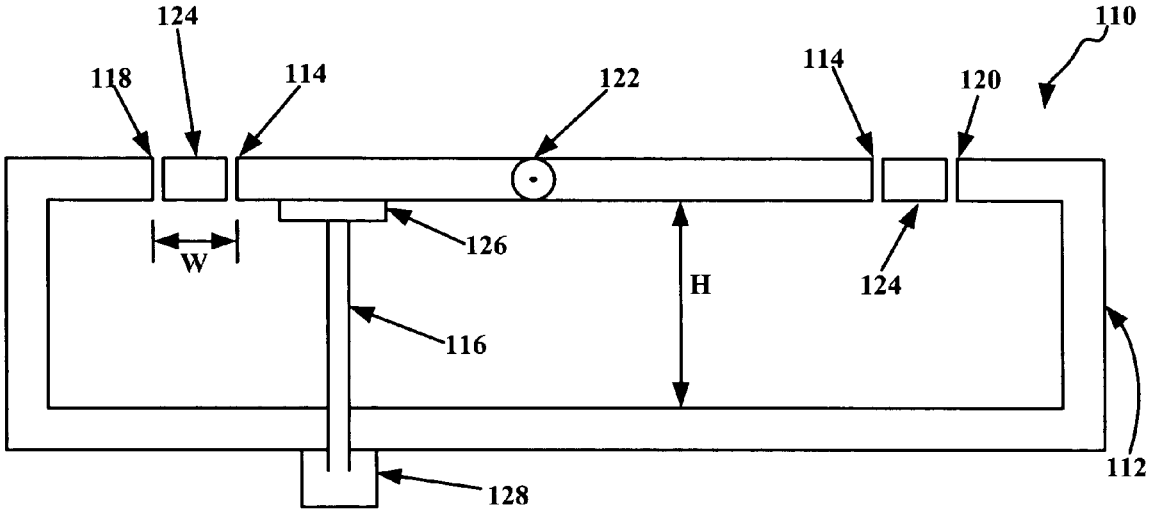
FIG. 3 is a cross-sectional side view of an antenna, in accordance with a second exemplary embodiment of the invention.
Figure 4:
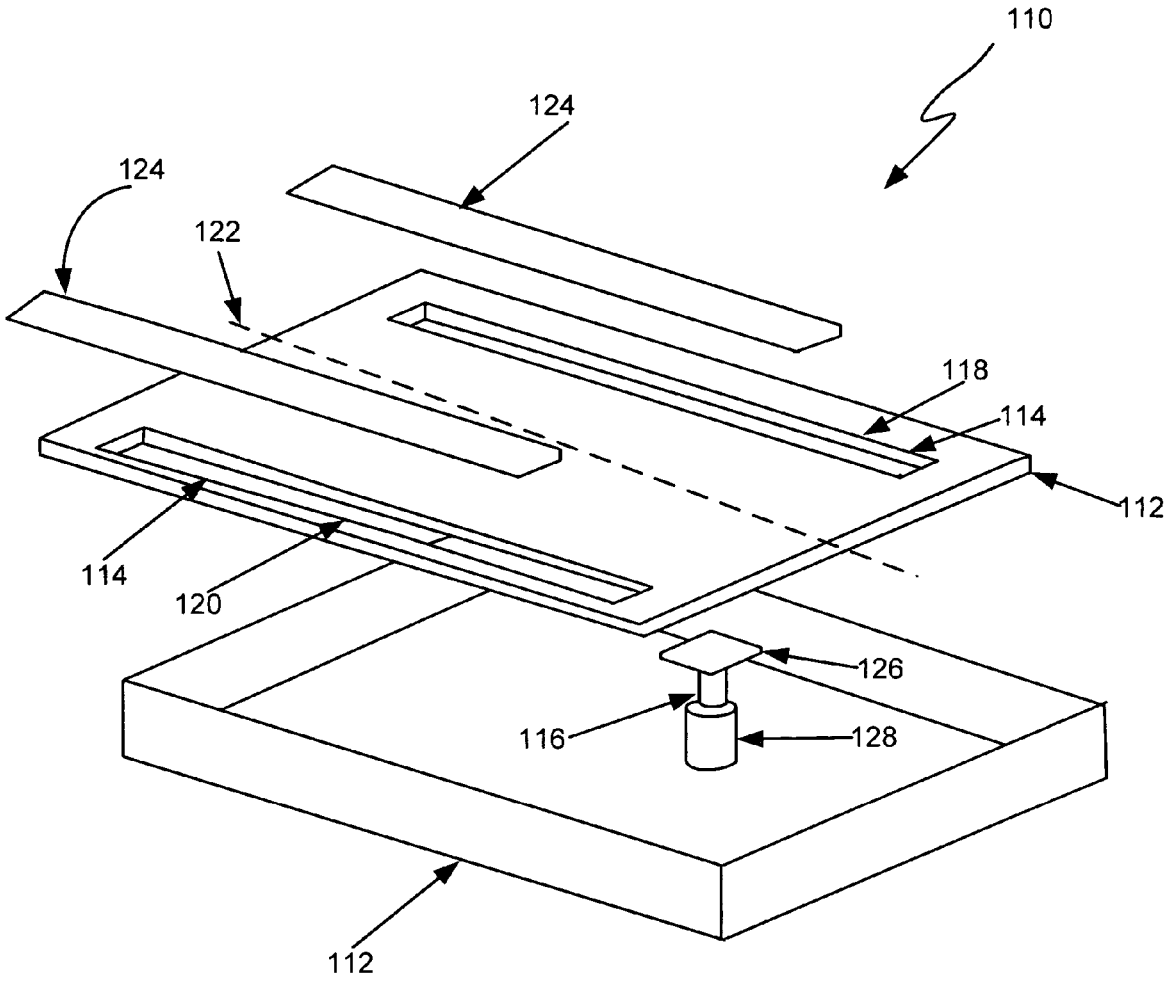
FIG. 4 is an exploded view of the antenna of FIG. 3, in accordance with the second exemplary embodiment of the invention.

FIG. 3 is a cross-sectional side view of an antenna 110, in accordance with a second exemplary embodiment of the invention. FIG. 4 is an exploded view of the antenna 110, in accordance with the second exemplary embodiment of the invention. The antenna 110 includes a metallic enclosure 112 having a height dimension H. At least one slotted opening 114 is formed along the metallic enclosure 112. Each slotted opening 114 has a slotted opening length L and a slotted opening width W. The slotted opening length L is at least twice as long as the slotted opening width W is wide. The slotted opening width W is less than one wavelength wide and the slotted opening width W is within a half wavelength of the height dimension H of the metallic enclosure 112. At least one feed 116 is provided at least partially within the metallic enclosure 112.

As shown in FIG. 3 and FIG. 4, the at least one slotted opening 114 in the second exemplary embodiment includes two slotted openings 114. The slotted openings 114, include a proximate slotted opening 118 and a distal slotted opening 120 in parallel along a side of the metallic enclosure 112. Other configurations of the slotted openings 114 are within the scope of the invention, including nonlinear slotted openings, intersecting slotted openings, and configurations having more or less than two slotted openings. Those having ordinary skill in the art will recognize the many possible configurations that exist.

The at least one feed 116 may be a probe feed located at least partially within the metallic enclosure 112. The feed 116 may be positioned closer to the proximate slotted opening 118 than to the distal slotted opening 120. A slotted opening axis 122 is shown in FIG. 4, located midway between the distal slotted opening 120 and the proximate slotted opening 118. The feed 116 may be located approximately 0.25 wavelengths from the slotted opening axis 122. The feed 116 is protected from physical abuse by the metallic enclosure 112, which substantially encompasses the feed 116.

A non-metallic shield 124, shown in FIG. 4, may be used to substantially cover each of the two slotted openings 114. The shields 124 may be used to impede dust and moisture from entering the metallic enclosure 112. The non-metallic shields 124, for instance, may pressure fit into the two slotted openings 114, although other means of securing the non-metallic shields 124 within the slotted openings 114 are known to those having ordinary skill in the art. The non-metallic shields 124 may sit at least partially within or exterior to the metallic enclosure 112, without deviating from the scope of the invention. The non-metallic shields 124 further the protection from physical abuse provided to the feed 116 by the metallic enclosure 112.

The non-metallic shields 124, for instance, may be constructed from a plastic material, although other materials may also be used to achieve the same objective of impeding dust and moisture from entering the metallic enclosure 112. Some materials, which may be used for the non-metallic shields 124, may impact the signal from the feed 116, due, for instance, to dielectric loading. When constructing the metallic enclosure 112 for the antenna 110, the width W of the slotted openings 114 may be sized relative to whether non-metallic shields 124 will be used that impact the signal from the feed 116. For instance, some plastics that may be used for the non-metallic shields 124 may require reducing the width W of the slotted openings 114 by approximately 10% to account for the dielectric loading of the plastic. As a result of this reduction, in part, the slotted opening 114 width W may be designed to be approximately between eighty and ninety-five percent of the height dimension H of the metallic enclosure 112.

The antenna 110 may also include a matching block 126 attached to an end of the feed 116. The matching block 126 may be metallic and may be soldered to the end of the feed 116. On an opposing end of the feed 116, a coaxial connector 128 may be provided. The coaxial connector 128, which may, for instance, be a 50-Ohm connector, allows the feed 116 to connect through the metallic enclosure 112 to an external signal source. Polarization from the antenna 110 of the second exemplary embodiment may be described as linear.

Figure 5:
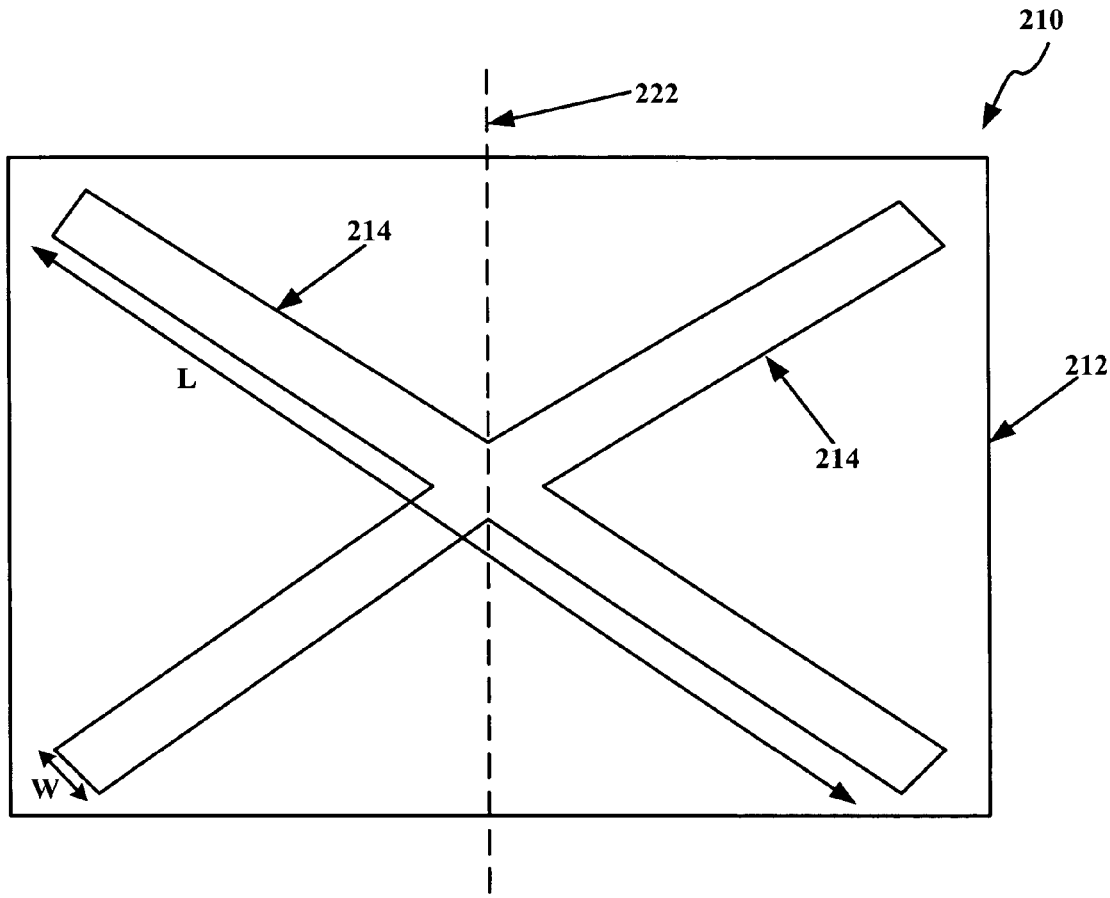
FIG. 5 is a top view of an antenna, in accordance with a third exemplary embodiment of the invention.
Figure 6:
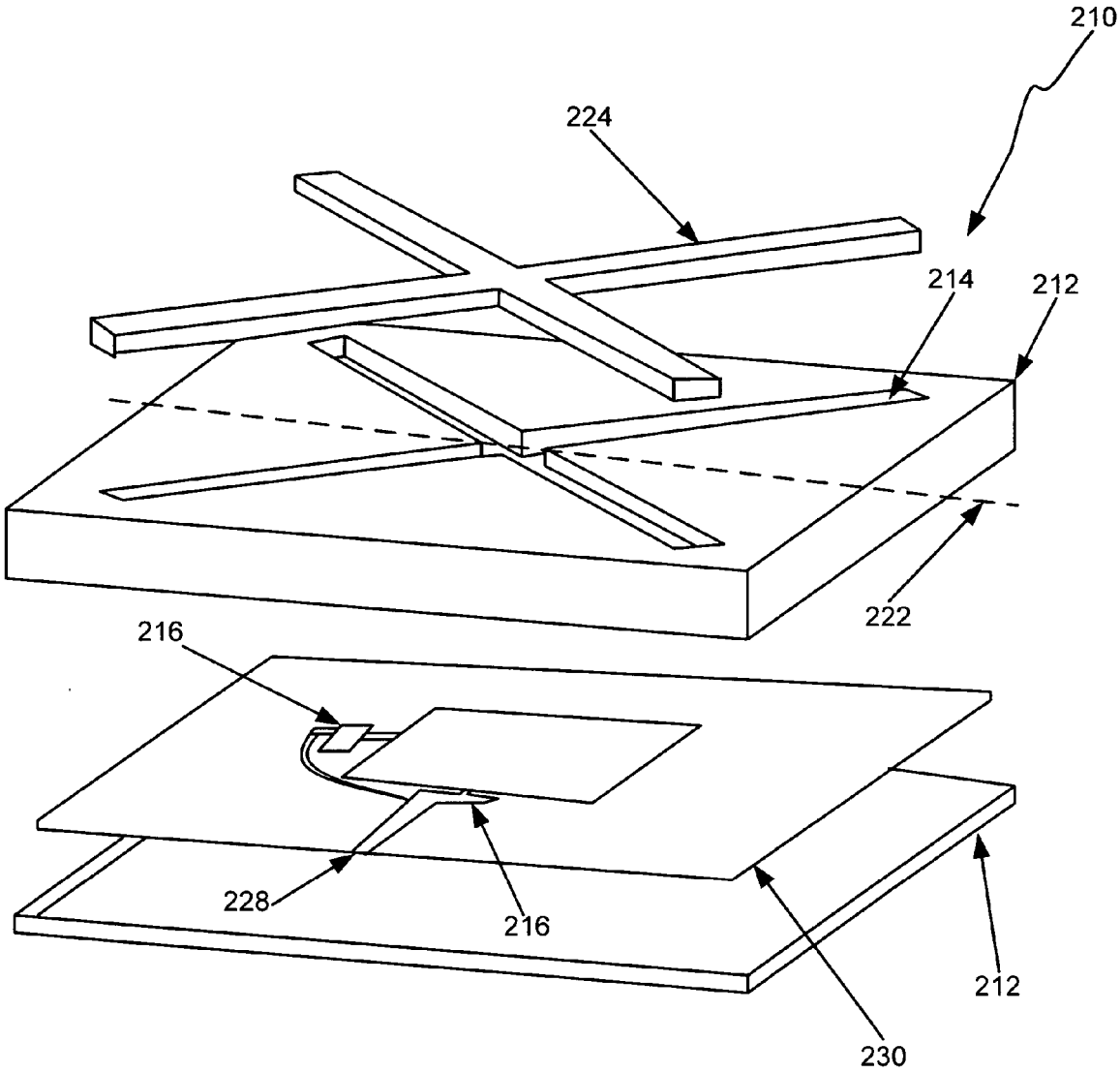
FIG. 6 is an exploded view of the antenna of FIG. 5, in accordance with the third exemplary embodiment of the invention.

FIG. 5 is a top view of an antenna 210, in accordance with a third exemplary embodiment of the invention. FIG. 6 is an exploded view of the antenna 210, in accordance with the third exemplary embodiment of the invention. The antenna 210 includes a metallic enclosure 212 having a height dimension H. At least one slotted opening 214 is formed along the metallic enclosure 212. Each slotted opening 214 has a slotted opening length L and a slotted opening width W. The slotted opening length L is at least twice as long as the slotted opening width W is wide. The slotted opening width W is less than one wavelength wide and the slotted opening width W is within a half wavelength of the height dimension H of the metallic enclosure 212. At least one feed 216 is provided at least partially within the metallic enclosure 212.

As shown in FIG. 5 and FIG. 6, the at least one slotted opening 214 in the third exemplary embodiment includes two intersecting slotted openings 214. The two slotted openings 214 intersect at a midsection of the two slotted openings 214. The two slotted openings 214 may intersect at different locations along the slotted openings 214, with varying levels of performance resulting. The two intersecting slotted openings 214 may also be nonlinear, although performance may be improved by at least maintaining some symmetry between the slotted openings 214 across a slotted opening axis 222.

As shown in FIG. 6, the at least one feed 216 may include two patch antennas, referred to herein as patch ports, on a dielectric substrate 230. The configuration of the patch ports shown in FIG. 6 may be described as a circular polarized patch. The two patch ports are fed ninety degrees out of phase. The patch ports may connect to a source external to the metallic enclosure 212 at a feed connection point 228. The feed connection point 228 may be configured in any of a variety of ways to connect to many different types of wires or cables, depending on the application. The feed 216 is protected from physical abuse by the metallic enclosure 212, which substantially encompasses the feed 216.

A non-metallic shield 224, shown in FIG. 6, may be used to substantially cover the two slotted openings 214. The non-metallic shield 224 may be used to impede dust and moisture from entering the metallic enclosure 212. The non-metallic shield 224, for instance, may pressure fit into the two slotted openings 214, although other means of securing the non-metallic shield 224 within the slotted openings 214 are known to those having ordinary skill in the art. The non-metallic shield 224 may sit at least partially within or exterior to the metallic enclosure 212, without deviating from the scope of the invention. The non-metallic shield 224 further the protection from physical abuse provided to the feed 216 by the metallic enclosure 212.

The non-metallic shield 224, for instance, may be constructed from a plastic material, although other materials may also be used to achieve the same objective of impeding dust and moisture from entering the metallic enclosure 212. Some materials, which may be used for the non-metallic shield 224, may impact the signal from the feed 216, due, for instance, to dielectric loading. When constructing the metallic enclosure 212 for the antenna 210, the width W of the slotted openings 214 may be sized relative to whether a non-metallic shield 224 will be used that will impact the signal from the feed 216. For instance, some plastics that may be used for the non-metallic shield 224 may require reducing the width W of the slotted openings 214 by approximately 10% to account for the dielectric loading of the plastic. As a result of this reduction, in part, the slotted opening width W may be designed to be approximately between eighty and ninety-five percent of the height dimension H of the metallic enclosure 212. Polarization from the antenna 210 of the third exemplary embodiment may be described as circular. If the feed 216 were configured as a dual polarized patch, as opposed to the circular polarized patch shown in FIG. 6, the antenna 210 would instead produce dual polarization.

Figure 7:
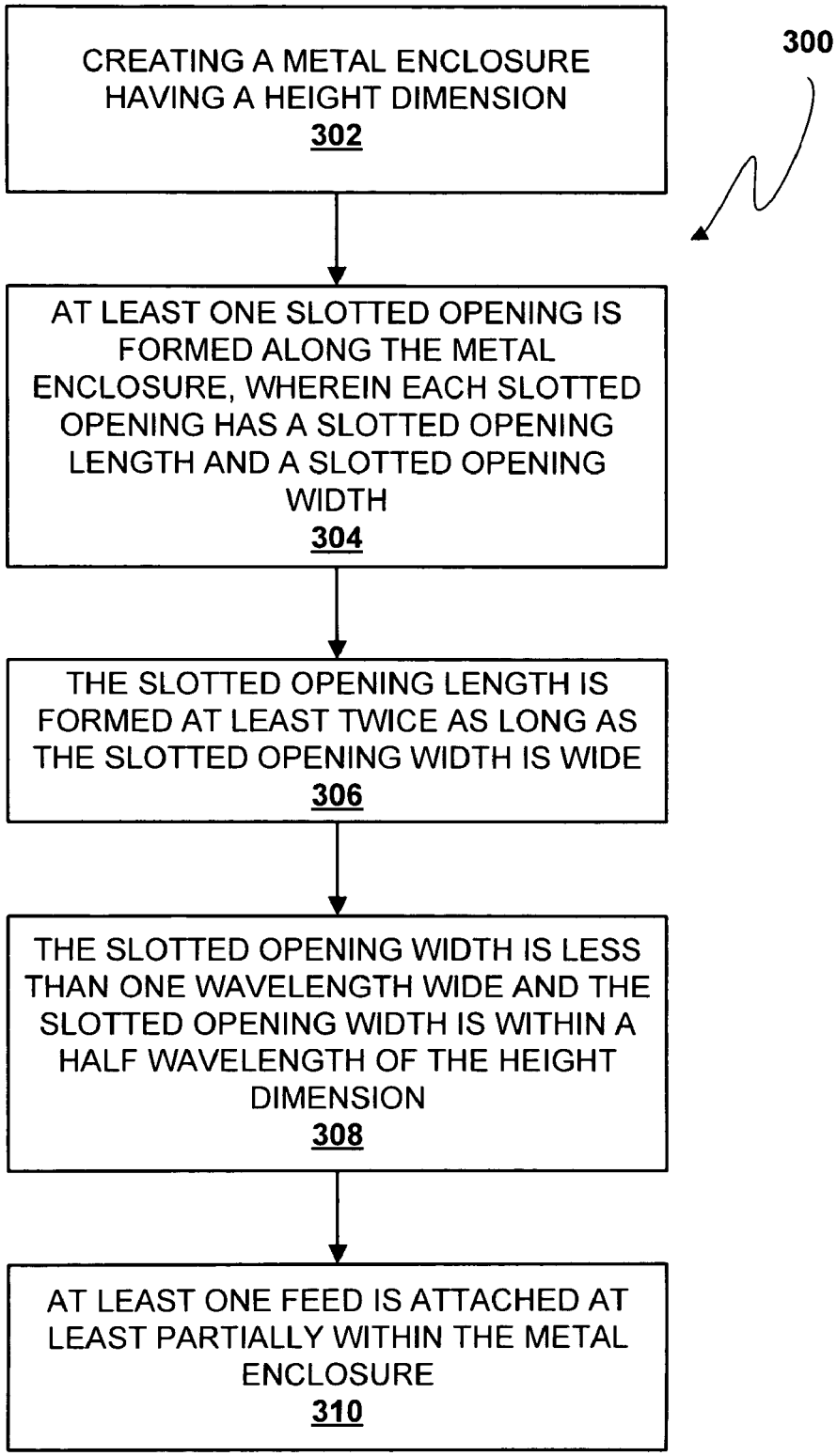
FIG. 7 is a flow chart showing the assembly of a possible implementation of the antenna in accordance with the first exemplary embodiment of the present invention.

The flow chart of FIG. 7 shows the assembly of a possible implementation of the antenna 10 (FIG. 1), in accordance with the first exemplary embodiment of the present invention. In this regard, each block represents a module, segment, or step, which comprises one or more instructions for implementing the specified function. It should also be noted that in some alternative implementations, the functions noted in the blocks might occur out of the order noted in FIG. 7. For example, two blocks shown in succession in FIG. 7 may in fact be executed substantially concurrently or the blocks may sometimes be executed in the reverse order, depending upon the functionality involved, as will be further clarified herein.

As shown in FIG. 7, a method 300 of assembling an antenna 10 may include creating a metallic enclosure 12 having a height dimension H (block 302). At least one slotted opening 14 is formed along the metallic enclosure 12, wherein each slotted opening 14 has a slotted opening length L and a slotted opening width W (block 304). The slotted opening length L is formed at least twice as long as the slotted opening width W is wide (block 306). The slotted opening width W is less than one wavelength wide and the slotted opening width W is within a half wavelength of the height dimension H (block 308). At least one feed 16 is attached at least partially within the metallic enclosure 12, protecting the feed 16 from external forces (block 310).

The slotted opening 14 may be formed to have a slotted opening width W of approximately 0.7 wavelengths. The antenna 10, may be assembled, as described herein, to create a directional antenna pattern that supports radio frequency identification technology standards in the 850-960 MHz frequency band. At least in part, the height dimension H of the metallic enclosure 12 affects the frequency bandwidth. An antenna 10 having a height dimension H of 0.08 wavelengths can produce a frequency bandwidth (12 dB return loss) in excess of 25%.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

We claim:

1. An antenna comprising:

a metallic enclosure having a height dimension;

at least two slotted openings formed along the metallic enclosure, including a proximate slotted opening and a distal slotted opening, wherein each slotted opening has a slotted opening length and a slotted opening width and the slotted opening length is at least twice as long as the slotted opening width is wide, and wherein the slotted opening width is less than one wavelength wide and the slotted opening width is within a half wavelength of the height dimension, the proximate slotted opening and the distal slotted opening are in parallel along a side of the enclosure;

at least one probe feed at least partially within the enclosure and closer to the proximate slotted opening than to the distal slotted opening; and a slotted opening axis located midway between the distal slotted opening and the proximate slotted opening, wherein the probe feed is located approximately 0.25 wavelengths from the slotted opening axis.

2. The antenna of claim 1, wherein the slotted openings are symmetrically located about the slotted opening axis.

3. The antenna of claim 1, further comprising a non-metallic shield substantially covering the two slotted openings, thereby impeding dust and moisture from entering the metallic enclosure.

4. The antenna of claim 1, wherein the slotted opening width is approximately between eighty and ninety-five percent of the height dimension.

5. The antenna of claim 1, further comprising a matching block attached to an end of the feed probe.

6. The antenna of claim 1, wherein at least one of the slots is nonlinear.

7. An antenna comprising:

a metallic enclosure having a height dimension;

two slotted openings, the two slotted openings intersecting at a middle of the two slotted openings, the two slotted openings formed along the metallic enclosure, wherein each slotted opening has a slotted opening length and a slotted opening width and the slotted opening length is at least twice as long as the slotted opening width is wide, and wherein the slotted opening width is less than one wavelength wide and the slotted opening width is within a half wavelength of the height dimension; and at least one circularly polarized feed at least partially within the enclosure;

the at least one circularly polarized feed further comprises two patch ports fed ninety degrees out of phase.

8. The antenna of claim 7, further comprising a non-metallic shield substantially covering the two slotted openings, thereby impeding dust and moisture from entering the metallic enclosure.

9. The antenna of claim 7, wherein the slotted opening width is approximately between eighty and ninety-five percent of the height dimension.

10. A method of assembling an antenna, the method comprising the steps of:

creating a metallic enclosure having a height dimension;

forming at least two slotted openings along the metallic enclosure, including a proximate slotted opening and a distal slotted opening, wherein each slotted opening has a slotted opening length and a slotted opening width and the slotted opening length is at least twice as long as the slotted opening width is wide, and wherein the slotted opening width is less than one wavelength wide and the slotted opening width is within a half wavelength of the height dimension; and attaching at least one feed at least partially within the enclosure, closer to the proximate slotted opening than to the distal slotted opening, wherein forming at least two slotted openings comprises forming two similarly sized slotted openings substantially symmetrically located about an axis of the metallic enclosure, wherein the step of attaching at least one feed further comprises attaching one feed approximately 0.25 wavelengths from the axis of the metallic enclosure.

11. The method of claim 10, further comprising attaching a coaxial connector to the at least one feed, wherein the coaxial connector is at least partially exterior to the enclosure.

12. The method of claim 10, further comprising the step of blocking the slotted openings with non-metallic shields thereby impeding dust and moisture from entering the metallic enclosure.

13. The method of claim 10, wherein forming at least two slotted openings comprises forming two slotted openings intersecting at a middle of the two slotted openings.

* * * * *